United States Patent [19]

Horner

[11] Patent Number: 4,704,824

[45] Date of Patent: Nov. 10, 1987

[54] PUNCH TOOL GRINDER AND METHOD

[76] Inventor: Tommy D. Horner, 3440 N. Beltline Rd., No. 1066, Irving, Tex. 75062

[21] Appl. No.: 909,121

[22] Filed: Sep. 18, 1986

Related U.S. Application Data

[62] Division of Ser. No. 718,961, Apr. 5, 1985, Pat. No. 4,656,786.

[51] Int. Cl.[4] ..... B24B 1/00

[52] U.S. Cl. ..... 51/281 R; 51/277

[58] Field of Search ..... 51/34 E, 34 R, 50 R, 51/45, 32, 225, 227, 123, 131.1, 214, 220, 216 ND, 216 H, 217 R, 217 T, 217 A, 218 R, 232, 237 R, 125.5, 277, 281 R, 219 R; 279/5, 1 A, 123; 269/74, 75, 123; 29/465; 76/5 R, 5 B

[56] References Cited

U.S. PATENT DOCUMENTS

| | | | |
|---|---|---|---|
| 1,233,608 | 7/1917 | Sacrey | 51/277 |
| 2,548,277 | 4/1951 | Whittlesey | 51/277 |
| 2,580,884 | 1/1952 | Bowman | 51/219 R X |
| 2,998,258 | 8/1961 | Ambrose | 279/123 |

*Primary Examiner*—Robert P. Olszewski
*Assistant Examiner*—Debra S. Meislin
*Attorney, Agent, or Firm*—Sigalos & Levine

[57] ABSTRACT

A method of aligning a punch tool for grinding a surface thereof on a grinding machine. The method for aligning comprises the steps of releasably holding the surface of the punch tool to be ground perpendicular to the rotation axis of a rotatable chuck of the grinding machine and parallel to the direction of slidable movement of a grinding wheel of the grinding machine; clamping the punch tool in the chuck so that the surface remains in the releasably held position; and releasing the releasably held surface of the punch tool so that the tool remains clamped in the chuck and the punch tool surface can be ground.

4 Claims, 9 Drawing Figures

FIG. 1
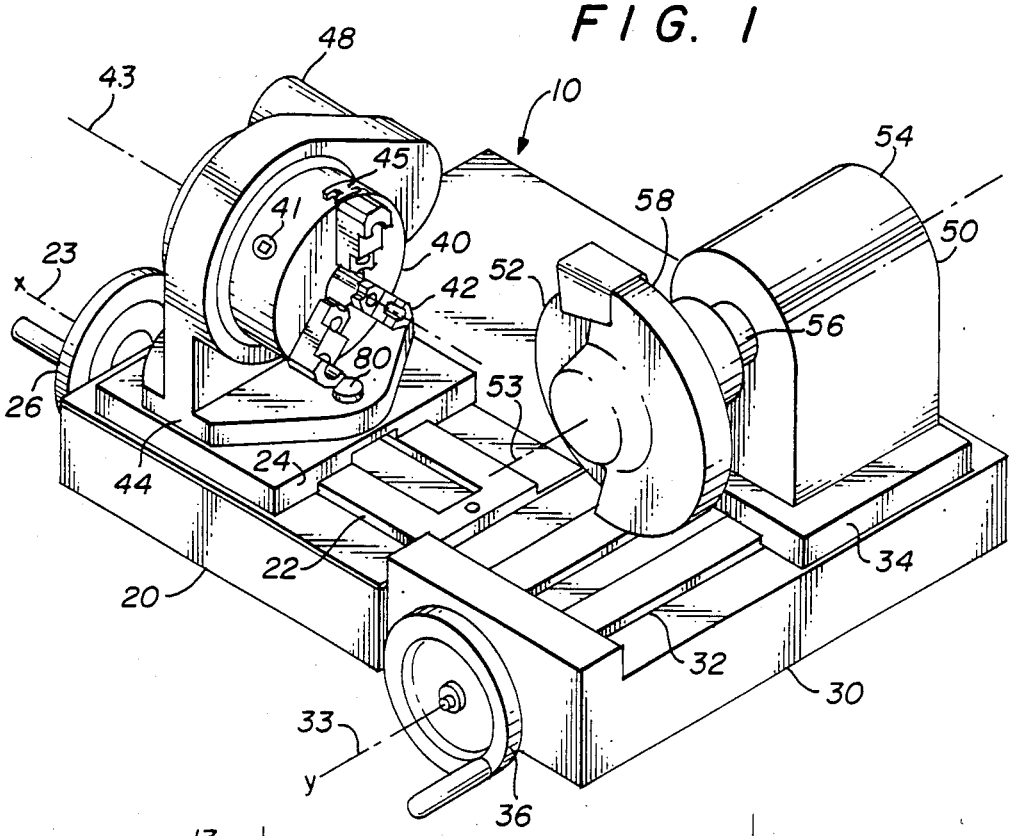
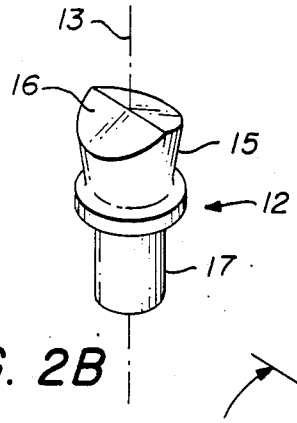
FIG. 2B
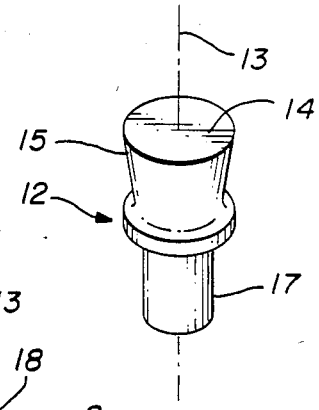
FIG. 2A
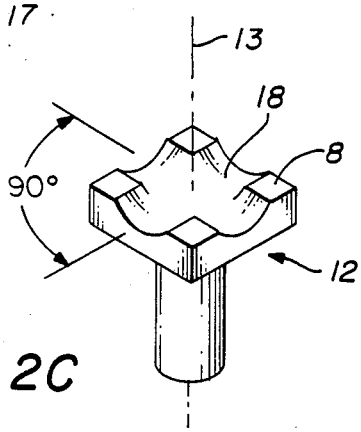
FIG. 2C

PUNCH TOOL GRINDER AND METHOD

This is a division of application Ser. No. 718,961, filed Apr. 5, 1985, now U.S. Pat. No. 4,656,786.

BACKGROUND OF THE INVENTION

This invention relates to a punch tool grinding machine and method. Punch tools are typically made of hardened wear-resistant metal for use in impacting sheets of other material such as softer steels, aluminums, brass, or nonmetallic materials such as paper or cloth. The sheets of material are supported by a die having a hole therein corresponding in size and shape to the punch tool which is held in alignment therewith by a punch press or a stamping machine. The punch press or stamping machine applies high pressure or high impacting force to the punch tool to cause it to punch a hole in the material. It is important for the proper operation of the punch tool that the edges of the tool, which correspond to the shape of the hole desired, be maintained in a sharp condition.

As the punch tool is used repeatedly, the peripheral edges of the impacting face of the tool will wear, round-off, or otherwise deteriorate. Depending upon the material being punched, the resistance to shear may be very high. For example, twenty thousand to forty-five thousand pounds per square inch for aluminum (137.9 $GN/m^2$ to 278.5 $GN/m^2$) and thirty-five thousand pounds per square inch to one hundred fifty thousand pounds per square inch for steel (241.3 $GN/m^2$ to 1,034 $GN/m^2$). To withstand such pressures, the tools are necessarily made of hardened tool steel. Thus, grinding is required to sharpen the punch tools.

Punch tools come in various shapes and configurations, including flat shear faces, slanted or angled shear faces, roof-top or double shear face configurations, as well as hollow-ground shear faces. Efforts have been made to provide quick and efficient machines for grinding the faces of such tools. Previously these efforts have not been totally successful.

Alignment problems arise when tools to be ground have shear faces which are not perpendicular to the axis of the punch tool. Usually the shear face must be ground flat so that a sharp angle is formed along the intersection of the side and the face. Alignment by standard shimming and adjusting means is time consuming and costly, especially when the shear angles vary from tool to tool.

Attempts have been made to solve these problems using elaborate and expensive machines. For example, a tool grinder uses a special wheel designed for grinding on its side rather than on its circumference face. In this machine the punch tool face is aligned and held square to the side of the grinding wheel for grinding. When the face of the punch tool is perpendicular to the shank of the tool, alignment can be accomplished by grasping the shank in a chuck. However, in order to grind punch tools having a shear angle not perpendicular to the axis of the tool, it is necessary to prop up one side of the chuck at an angle using a dowel pin. The side of the rotating grinding wheel is then moved into grinding contact with the tool face. This method is cumbersome and it requires guesswork and tedious measurements to precisely place the dowel pin under the chuck to obtain the desired angle corresponding to the shear angle on the tool. Also, this requires a special grinding wheel designed for extensive side grinding.

Another machine for sharpening punch tools employs a wide sanding belt. To grind a punch tool which has an angular shear surface, a chuck and sine plate assembly are required. The entire chuck and sine plate assembly are rotated beneath the wide grinding belt. In order to sharpen a punch tool with a concave shear surface, a complex universal chuck is required. This complex chuck employs special cams and cam followers to manipulate the angle of the chuck and the punch tool held therein as the chuck is rotated beneath the grinding belt.

The present invention relates to an improved grinding machine which overcomes problems associated with existing punch tool grinding machines. An object of the present inventive machine is to permit quick alignment of a punch tool for grinding its face whether the tool face is perpendicular to its shank or whether the face is at a shear angle. Even multiple shear angle faces can be quickly aligned for grinding.

Another object of the present invention is to provide for use of a standard inexpensive grinding wheel which is designed for grinding at its periphery. A substantially constant grinding speed can be maintained because the high speed grinding surface at the periphery of the grinding wheel contacts the punch tool. Each abrasive particle at the periphery is at an equal distance from the axis of rotation and is traveling at the same speed. This compares favorably with grinding machines which rely upon a flat side to grind a flat surface. Where the side of the grinding wheel is used, the abrasive particles of the wheel which contact the punch tool near the center of the wheel have a slower relative speed than the abrasive particles of the wheel which contact the punch tool near the outside of the wheel.

Another object of the invention is to provide a grinding machine and method for grinding not only for various face configurations of punch tools, but also for grinding relief angles on the sides of punch tools.

Another object of the present invention is to provide an inexpensive grinding machine having an "x" axis along which a tool-holding rotating chuck can be moved and a "y" axis along which a motorized grinding wheel can be adjustably moved.

Another object of the invention is to provide a means for rotating the tool-holding chuck at a constant speed when desired and means for holding the chuck stationary at various indexed angles of rotation for performing a grinding procedure at such stationary position.

Another object of the present invention is to provide pivotable means for mounting the chuck on the "x" guideway so that its axis of rotation can be pivoted to desired angles from the "x" axis guideway on which it is mounted. A further object is to provide for index pins at predetermined chuck pivot angles.

SUMMARY OF THE INVENTION

The invention relates to a device for quickly aligning a punch tool for grinding a surface of it. The device is for use in a grinding machine of the type having an "x" direction guideway, a "y" direction guideway at right angles to the "x" direction guideway, a rotatable chuck slidably mounted on the "x" direction guideway, a motor driven grinding wheel slidably mounted on the "y" direction guideway with the axis of rotation of the grinding wheel parallel to the "y" direction guideway. The improved aligning device comprising a punch tool holding means having a spheroidal outer surface; at least two adjustable jaws in said rotatable chuck having a first position of adjustment at which the jaws are in opposed sliding contact with the spheroidal outer surface of the punch tool holding means and a second position at which the jaws clamp against the spheroidal outer surface of the tool holding means; and abutment means movably attached to the grinding machine for abutting against a face of a punch tool, perpendicular to the axis of rotation of the rotatable chuck with the adjustable chuck jaws in the sliding contact position and which abutment means is movable away from the punch tool face when the jaws are in the clamped position so that the punch tool face can be ground by said grinding wheel.

The invention further relates to a method of aligning a punch tool for grinding a surface thereof on a grinding machine of the type having two perpendicular guideways with a rotatable chuck slidably mounted on a first one of the guideways and with a motor driven grinding wheel mounted on a second one of the perpendicular guideways for slidable movement in the direction of the axis of rotation of the grinding wheel parallel to the second guideway. The method for aligning comprises the steps of releasably holding the surface of the punch tool to be ground perpendicular to the axis of rotation of the rotatable chuck and parallel to the direction of slidable movement of the grinding wheel; clamping the punch tool in the chuck so that the surface remains in the releasably held position; and releasing the releasably held surface of the punch tool so that the tool remains clamped in the chuck and the punch tool surface can be brought in contact with said grinding wheel.

BRIEF DESCRIPTION OF THE DRAWINGS

These and other objects of the instant invention may be had by referring to the following specification and drawings in which like numerals indicate like components and in which:

FIG. 1 is a perspective view of the grinding machine showing the "x" and "y" guideways and showing the rotatable chuck and the motor driven grinding wheel slidably mounted on each guideway respectively.

FIG. 2*a* is a perspective view of one configuration of a punch tool for making round holes, which punch tool has a flat face.

FIG. 2*b* is a perspective view of another configuration of a punch tool for making round holes having a "roof-top" double-face with the shear angle of each face down.

FIG. 2*c* is a perspective of a square punch having a complex, concave shear face.

DETAILED DESCRIPTION OF THE DRAWINGS

Figure 3A:
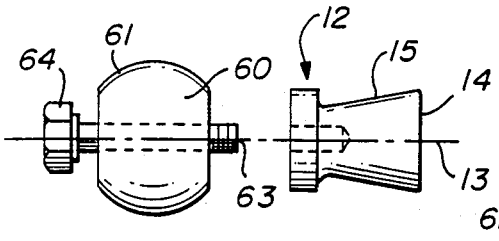
FIG. 3*a* is a side view of an inventive tool holding means for aligning and holding shankless punch tools for grinding.

Referring now to the figures in greater detail, and first to FIG. 1, this figure shows a perspective view of a grinding machine, generally designated as 10, on which guideway base 20 and guideway base 30 are mounted. Guideway 22 on base 20 is aligned along axis 23 which shall be designed the "x" axis. Mounting table 24 is slidably mounted horizontally on guideway 22 and can be moved therealong and held at any given position using adjustment means 26. Mounted on table 24 is rotatable chuck 40. Axis 43, about which chuck 40 rotates, is held parallel to the horizontal plane defined by sliding table 24 using chuck mounting means 44.

A second sliding table 34 is mounted horizontally on a second guideway 32 for movement along an axis 33 perpendicular to said "x" axis, which second axis shall be designated the "y" axis. Adjustable movement of table 34 is achieved using adjustment handle 36.

Mounted on slidable table 34 is grinder 50, which includes a grinding motor 54, having a grinding shaft 56 with an axis of rotation 53. Mounted for high speed rotation on shaft 56 is grinding wheel 52 enclosed by the safety shroud 58. As shown in FIG. 1, grinder axis 53 is parallel to "y" axis 33. When chuck rotation axis 43 is aligned parallel to the "x" axis 23, grinder axis 53 is perpendicular to chuck rotation axis 43.

In the embodiment shown in FIG. 1, chuck 40 is a chuck of the type having three jaws. Using jaw adjustment means 41, all three jaws 42 are moved progressively inwardly or outwardly along slide-guides 45, with all three jaws moving at the same rate. Thus, a punch tool or die having a circular cross-section can be grasped between the jaws concentric with axis 43.

With reference now to FIG. 2*a*, which is a punch tool, shown generally as 12 having a shaft 17 with a circular cross-section and a face 14 shown perpendicular to tool axis 13. It can be understood that jaws 42 in the configuration shown in FIG. 1 would grasp tool shaft 17, so that tool axis 13 and chuck axis would coincide. Upon rotation of chuck 40 using rotation motor 48 and with the punch tool 12 of FIG. 2*a* grasped therein, flat tool face 14 would define a plane perpendicular to axis 43. Using "x" axis adjustment means 26, the rotating tool could be brought along the "x" axis 23 and thereby along chuck axis 43 into contact with a motor driven grinding wheel 52. While holding the rotating chuck 40 at the contact position as by holding "x" axis adjustment means 26 at a fixed position, grinding wheel 52 can be moved along the "y" axis 33 using "y" axis adjustment means 36, such that a grinding pass is made completely across rotating tool face 14 thereby sharpening the punch tool 12.

With reference to FIG. 2*b*, it can be seen that punch tool 12 may have a shear angle face 16 or multiple faces 16. It will be understood by those skilled in the art that the shear angles shown may be compound multi-directional shear angles rather than the regular roof-top angle shown. The present invention is applicable to either configuration. Shear angle faces 16 cannot be ground using the method and configuration of the grinding machine as described in the paragraph above. To overcome this inadequacy without resorting to complex sine plate arrangements and expensive side loadable grinding wheels, the present invention further comprises punch tool holding means 60 as shown in alternative embodiments in FIG. 3*a* and FIG. 3*b*. Punch tool holding means 60, has an outer surface 61, a portion of which is spheroidal.

Figure 3B:
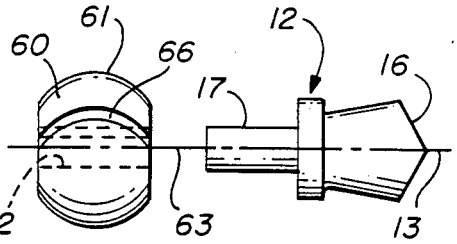
FIG. 3*b* is a side view of an inventive tool holding means for aligning and holding punch tools having straight shanks thereon.

FIG. 3*a* shows means for rigidly attaching a punch tool 12 to the holding means 60. In the event tool 12 is of the type without a shaft 17 attached thereto, then attachment means 64 may be, for example, any known threaded fastener 64. Punch tool 12 is attached such that tool axis 13 is concentric with the central axis of the spheroidal surface 61.

In an alternative embodiment tool holding means 60 is formed with a means 66 for rigidly attaching punch tool 12 thereto. In this embodiment tool holding means 60 has a bore 62 formed therein with a circular cross-section and a split 66 extending along the length of the bore and extending through the outer spheroidal surface of holding means 60. Bore 62 corresponds in diameter to shaft 17 such that shaft 17 may be manually slid into bore 62. Pressure on the outside spheroidal surface 61, which pressure may be applied using jaws 42 will cause the gap formed between the opposed surfaces of slit 66 to close slightly by flexing the material of tool holder 60 and thereby decreasing the diameter of the bore 62 therein so that shank 17 is frictionally locked in punch tool holding means 60.

Figure 4:
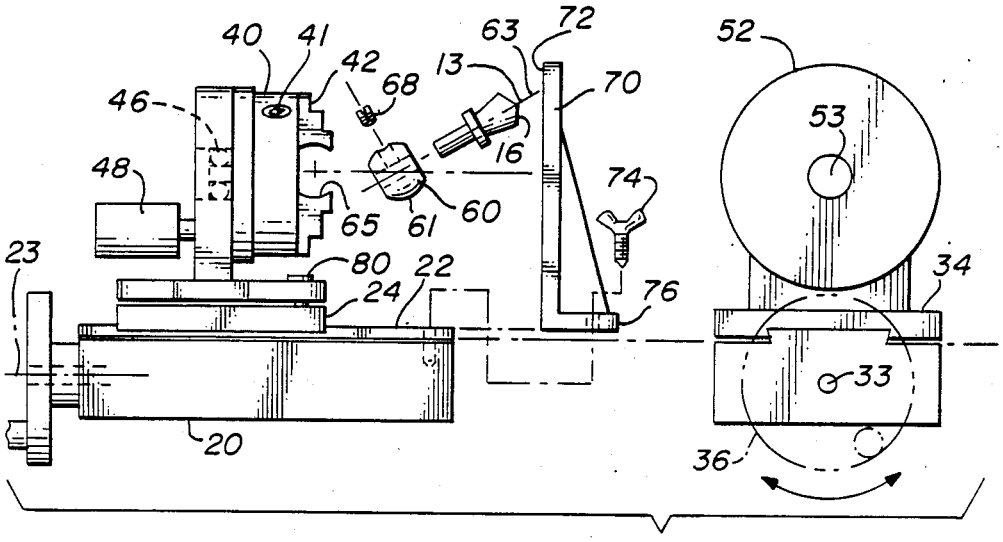
FIG. 4 is a side view showing one embodiment of the inventive grinding machine and movable abutment plate and exemplifying the inventive method for aligning a punch tool for grinding.

With reference to FIG. 4, it can be understood that chuck jaws 42 in the preferred embodiment have concave spherical surfaces 65 formed therein corresponding to the spheroidal outer surface 61 of tool holding means 60. Where concave spherical jaw surfaces 65 are used it may be possible to use a chuck with two jaws or any number of jaws greater than two. Also shown in an alternative locking means 68 which is a set screw 68 which threads through tool holding means 60 for engagement with tool shaft 17.

In FIG. 4, the inventive method of the aligning punch tool for grinding the surface thereof is demonstrated. The method of aligning the punch tool for grinding the surface thereof comprises the steps of releasably holding the surface 16 of punch tool 12 to be ground perpendicular to chuck rotation axis 43 and parallel to the direction of slidable movement of grinding wheel 52; clamping the punch tool 12 in chuck 40 so that surface 16 remains in the position in which it was releasably held; and releasing the releasably held surface 16 of punch tool 12 so that the tool 12 remains clamped in chuck 40 and punch tool surface 16 can be brought into contact with grinding wheel 52.

As can be understood with reference to FIG. 4 the step of releasably holding surface 16 further comprises the steps of aligning the axis of rotation 43 of chuck 40 parallel to guideway 22 or the "x" axis on which chuck 40 is slidably mounted; movably attaching abutment plate 70 to the grinding machine perpendicular to the axis of rotation 43 and between chuck 40 and grinding wheel 52; and releasably abutting surface 16 of punch tool 12 in contact with plate 70 so that surface 16 is releasably held by friction perpendicular to the axis of rotation 43 of chuck 40. Plate 70 may be movably attached by affixing it perpendicular to a foot 76, which foot 76 is attached using fastener 74 which may be a threaded fastener such as a wing bolt or wing nut and bolt arrangement. Of course, plate 70 and surface 16 must be wiped clean so that complete abutment is achieved manually by the operator of the machine. The step of clamping the punch tool further comprises the steps of detachably attaching punch tool 12 rigidly to a spheroidal surface, such as spheroidal surface 61 on tool holding means 60, adjacent to the punch tool surface 16 which is to be ground; moving to the chuck jaws 42 inwardly into clamping contact with the spheroidal surface 61 while the punch tool surface 16 remains abutted against plate 70 so that it is releasably held perpendicular to the axis of rotation of the chuck; and frictionally locking the chuck jaws 42 in clamping contact therewith. Frictional locking is achieved by applying sufficient tension through a chuck jaw adjustment means 41, which frictional locking occurs naturally with most known chucks of the types described herein. The step of releasing said releasably held surface 16 of said punch tool 12 so that the punch tool remains clamped into the chuck 40 comprises the steps of releasing the plate 70 from abutting contact with punch tool surface 16 after the step of clamping the punch tool in chuck 40; and moving the plate 70 from between chuck 40 and grinding wheel 52 so that tool surface 16 can be brought into grinding contact with grinding wheel 52 as by slidably moving chuck 40 using chuck adjustment means 26. Using this method, surface 16 remains perpendicular to axis of rotation of the chuck 43 so that the relative motion of the tool face 16 in the rotating chuck 40 and the grinding wheel moved along guideway 32 defines a plane corresponding to the plane surface 16.

Figure 5:
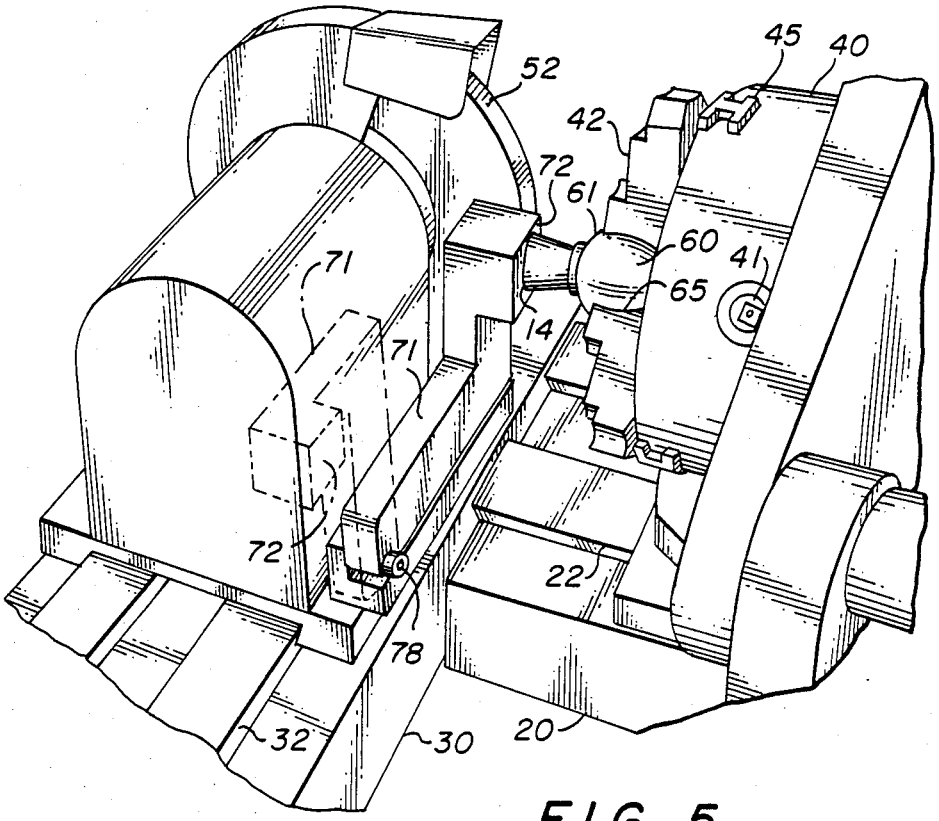
FIG. 5 is a perspective view of another embodiment of the inventive grinding machine showing a pivotal abutment plate and inventive method of punch tool alignment.

In an alternative preferred embodiment shown in FIG. 5, plate 71 is a pivotable abutment plate 71 which performs the same function as abutment plate 70 in FIG. 4. Plate 71 which pivots on pivot pin 78 to a first position adjacent to grinding wheel 52 with a surface 73 performing the same function as surface 72 in FIG. 4 by remaining parallel to grinding axis 53. After the tool is releasably held against surface 73 and clamped through tool holding means 60 into chuck jaws 42, then pivotable abutment plate 71 can be pivoted to a second position shown with phantom lines in FIG. 5. Thus, the grinding operation can take place unobstructed by plate 71. This eliminates the need of attachment means 74 and foot 76 and simplifies the step of moving plate 71 from between chuck 40 and grinding wheel 52 to a pivotal action instead of completely removing plate 70.

Figure 6:
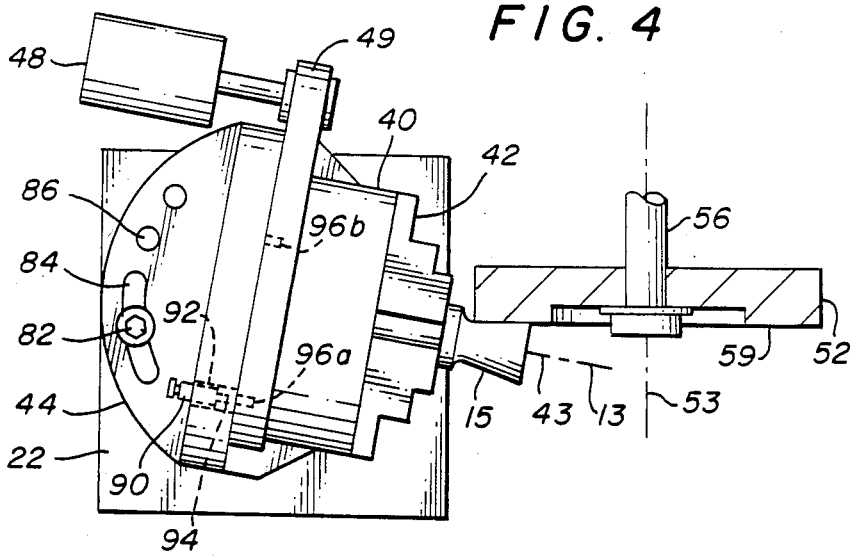
FIG. 6 is a top view of the inventive grinding machine showing the versatility of the machine for either indexing the rotatable chuck or for ginding side relief on punch tools.

FIG. 6 is a partial top view of the inventive grinding machine in which the versatility of the inventive grinding machine is demonstrated. Shown in FIG. 6 is tool 12 mounted with its axis 13 coincident with axis 43 of rotating chuck 40. To grind a punch tool diameter, the axis of rotatable chuck 40 is adjusted parallel to the axis and the side of grinding wheel 53 is brought into contact with the tool diameter. To grind relief surface 15 of the punch tool 12 with the desire relief angle, mounting means 44 is pivoted horizontally on table 24 about chuck mount pivot 80. Locking means 82 which may be a threaded fastener 82 is loosened so that the mounting means 44 can be manually pivoted to the desired angular relationship with the side of grinding wheel 52. Locking means 82 can be tightened at a different location within elongated slot 84, thereby holding the rotation axis 43 at any desired position with the slotted range. Where relief angles are standardized for a given industry or a given manufacturing brand or where other common angular relationships are desired, the inventive grinding machine employs corresponding locating means 86 which may be holes 86 which are drilled through mounting means 44 and table 24 so that a locating device such as a dowel rod can be inserted into the holes 86. Thus, the desired angular relationship is quickly and repeatably obtained.

Also shown in FIG. 6 is indexing pin 90 with a portion thereof 94 corresponding in size to multiple detents 96*a* and 96*b* formed in the chuck 40 regularly spaced about the periphery of chuck 40. The index detents 96*a* and 96*b* have a predetermined angular relationship with one another. For example, the detents may be spaced every ninety dergees around the periphery of chuck 40 so that there would be four detents formed therein, it being understood that any other desired spacing could be used.

With reference to the punch tool 12 shown in FIG. 2*c*, grinding the semicircular relief surfaces 18 is achieved by aligning chuck table 44 so that its axis of rotation 43 is parallel to "x" axis 23, flat faces 8 would be abutted against alignment plate 70 or plate 71 such that axis 13 is coincident with chuck axis 43 both of which are parallel to "x" axis 23. Plate 70 is then removed or plate 71 is pivoted to its second position. Rotary chuck drive motor 48 is turned off. Index pin 90 is pushed through aperture 92 so that engagment portion 94 engages a first detent 96(*a*) which acts to lock the chuck in place. The face of the punch tool is adjusted using adjustment means 26 into grinding contact with motor driven grinding wheel 52. Grinding wheel 52 is moved across the tool face using adjustment handle 36 to grind a semicircular surface 18 corresponding in diameter to the diameter of grinding wheel 52. Index pin 90 is then retracted, chuck 40 is rotated ninety degrees to permit engagment portion 94 to engage a second detent 96(*b*) which is spaced at ninety degrees to the first detent 96(*a*). Then grinding wheel 52 is passed across the tool face to grind a second semicircular face 18 in the punch tool 12.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A method of aligning a punch tool for grinding a surface thereof on a grinding machine of the type having two perpendicular guideways with a rotatable chuck slidably mounted on a first one of said guideways and with a motor-driven grinding wheel mounted on a second one of said perpendicular guideways for slidable movement in the direction of the axis of rotation of said grinding wheel parallel to said second guideway, said method for aligning comprises the steps as follows:

(a) releasably holding said surface of said punch tool to be ground perpendicular to the axis of rotation of said rotatable chuck and parallel to the direction of slidable movement of said grinding wheel;

(b) clamping said punch tool in said chuck so that said surface remains in said releasably held position; and (c) releasing said releasably held surface of said punch tool so that said tool remains clamped in said chuck and said punch tool surface can be brought in contact with said grinding wheel.

2. A method as in claim 1 wherein said step of releasably holding said punch tool surface perpendicular to the axis of rotation of said rotatable chuck comprises the steps as follows:

(a) aligning the axis of rotation of said chuck parallel to said first one of said guideways on which said chuck is slidably mounted;

(b) movably attaching a plate to said grinding machine perpendicular to said axis of rotation of said chuck and between said chuck and said grinding wheel; and (c) releasably abutting said punch tool surface in contact with said plate so that it is releasaby held perpendicular to said axis of rotation of said chuck.

3. A method as in claim 2 wherein said chuck is of the type having movable clamping jaws and wherein said step of clamping said punch tool in said chuck so that said surface remains in said releasably held position comprises the steps as follows:

(a) detachably attaching said punch tool rigidly to a truncated spheroidal surface adjacent said punch tool surface to be ground; and (b) moving said chuck jaws inwardly into clamping contact with said spheroidal surface while said punch tool surface remains releasably held perpendicular to the axis of rotation of said chuck.

4. A method of aligning a punch tool for grinding a surface thereof as in claim 3 wherein said step of releasing said releasably held surface of said punch tool so that said tool remains clamped in said chuck comprises the steps as follows:

(a) after said step of clamping said punch tool in said chuck, releasing said plate from abutting contact with said punch tool surface; and (b) moving said plate from between said chuck and said grinding wheel so that said grinding wheel can be brought into grinding contact with said surface of said punch to which is clamped in said chuck.

* * * * *

UNITED STATES PATENT AND TRADEMARK OFFICE

CERTIFICATE OF CORRECTION

PATENT NO. 4,704,824

DATED November 10, 1987

INVENTOR(S) Tommy D. Horner

It is certified that error appears in the above-identified patent and that said Letters Patent are hereby corrected as shown below:

Column 8, Line 48, "to" should be deleted.

Signed and Sealed this

Thirty-first Day of May, 1988

*Attest:*

*Attesting Officer*

DONALD J. QUIGG

*Commissioner of Patents and Trademarks*